US007163498B1

(12) United States Patent
Abelbeck

(10) Patent No.: US 7,163,498 B1
(45) Date of Patent: Jan. 16, 2007

(54) CANTILEVERING LINEAR MOTION EXERCISE DEVICE AND METHOD OF PHYSICAL EXERCISE

(75) Inventor: Kevin G. Abelbeck, Encino, CA (US)

(73) Assignee: Abelbeck Partners, Ltd., Dallas, TX (US)

( * ) Notice: Subject to any disclaimer, the term of this patent is extended or adjusted under 35 U.S.C. 154(b) by 169 days.

(21) Appl. No.: 10/225,070

(22) Filed: Aug. 20, 2002

(51) Int. Cl.
*A63B 26/00* (2006.01)

(52) U.S. Cl. ..... 482/142; 482/92; 482/93; 482/94

(58) Field of Classification Search ..... 482/92–95, 482/142; D21/676, 686, 690
See application file for complete search history.

(56) References Cited

U.S. PATENT DOCUMENTS

| | | | | |
|---|---|---|---|---|
| 339,638 | A | 4/1886 | Goldie | |
| 682,988 | A | 9/1901 | Hazelip | |
| 1,621,477 | A | 3/1927 | Pilates | |
| 1,750,549 | A | 3/1930 | Thomson et al. | |
| 1,979,783 | A | 11/1934 | Williams et al. | 272/72 |
| 1,980,036 | A | 11/1934 | Casler et al. | 272/72 |
| 1,982,872 | A | 12/1934 | Husted | 272/72 |
| 1,996,350 | A | 4/1935 | Schaff | 272/79 |
| 2,733,922 | A | 2/1956 | Diego | 272/58 |
| 2,783,045 | A | 2/1957 | Bosch | 272/81 |
| 3,394,934 | A | 7/1968 | Elia et al. | 272/72 |
| 3,586,322 | A | 6/1971 | Kverneland | 272/72 |
| 3,770,267 | A | 11/1973 | McCarthy | 272/58 |
| 4,004,801 | A | 1/1977 | Campanaro et al. | 272/120 |
| 4,101,124 | A | 7/1978 | Mahnke | 272/134 |
| 4,272,074 | A | 6/1981 | Sferle | 272/120 |
| 4,383,684 | A | 5/1983 | Schliep | 272/120 |
| 4,468,025 | A | 8/1984 | Sterle | 272/120 |
| D284,597 | S | 7/1986 | Smith et al. | D21/195 |
| 4,706,953 | A | 11/1987 | Graham | 272/120 |
| 4,884,802 | A | 12/1989 | Graham | 272/136 |
| 4,911,438 | A | 3/1990 | Van Straaten | 272/138 |
| 4,915,378 | A | 4/1990 | Abrahamian et al. | 272/134 |
| 5,029,848 | A | 7/1991 | Sleamaker | 272/120 |
| 5,042,797 | A | 8/1991 | Graham | 272/120 |
| 5,066,005 | A | 11/1991 | Luecke | 272/136 |
| 5,103,808 | A * | 4/1992 | Iams et al. | 601/134 |
| 5,169,363 | A | 12/1992 | Campanaro et al. | 482/96 |
| 5,263,913 | A * | 11/1993 | Boren | 482/96 |
| 5,338,278 | A | 8/1994 | Endelman | 482/142 |
| 5,364,327 | A | 11/1994 | Graham | 482/122 |
| 5,607,381 | A | 3/1997 | Endelman | 482/142 |

(Continued)

*Primary Examiner*—Lori Amerson

(57) ABSTRACT

An exercise device that includes an upper frame with a user support that cantilevers over a lower frame provides for reduced storage and the potential for shipping in a pre-assembled state. The upper frame is supported by the lower frame with a rolling element there between. The rolling element can be in the form of rollers that are rotatably mounted to the foot portion of the upper frame and the head portion of the lower frame. The rolling element can also take the form of one of more rollers, which constantly articulate with each of the upper and lower frames. A spring bias is included to provide a resistance to movement of the upper frame with respect to the lower frame. The lower frame, and therefore the supported upper frame, can also be pivotally mounted to a base frame, thereby enabling the upper frame to be positioned in an inclined state. A pair of handles may also be used to actuate a cable that provides movement of the upper frame relative to the lower frame by displacement of the foot portion of the upper frame toward the head portion of the lower frame.

52 Claims, 15 Drawing Sheets

U.S. PATENT DOCUMENTS

| | | | | |
|---|---|---|---|---|
| 5,620,403 | A | 4/1997 | Lundin | 482/96 |
| 5,653,670 | A | 8/1997 | Endelman | 482/142 |
| 5,674,168 | A | 10/1997 | Wilkinson | 482/138 |
| 5,681,249 | A | 10/1997 | Endelman | 482/142 |
| 5,792,033 | A | 8/1998 | Merrithew | 482/96 |
| 5,906,564 | A | 5/1999 | Jacobsen | 482/96 |
| 5,938,571 | A | 8/1999 | Stevens | 482/96 |
| 6,024,677 | A | 2/2000 | Siwertz | 482/96 |
| 6,120,425 | A | 9/2000 | Endelman | 482/142 |
| 6,186,929 | B1 | 2/2001 | Endelman et al. | 482/121 |
| 6,244,995 | B1 * | 6/2001 | Prsala | 482/96 |
| 6,371,895 | B1 * | 4/2002 | Endelman et al. | 482/96 |
| 6,634,996 | B1 * | 10/2003 | Jacobsen | 482/96 |

* cited by examiner

CANTILEVERING LINEAR MOTION EXERCISE DEVICE AND METHOD OF PHYSICAL EXERCISE

FIELD OF THE INVENTION

The present invention generally relates to devices that enable physical exercise. More specifically, the present invention relates to exercise devices that support the body of the user and move through a reciprocating linear type motion.

BACKGROUND OF THE INVENTION

Medical science repeatedly confirms the human body's craving for physical exercise. Cardiovascular conditioning and resistance training, or strength training, are both extremely important in the overall health of the body. Strength training in particular offers a profound benefit to the maintenance of muscle mass, body composition and bone density. As strength training becomes more accepted as a part of our lifestyle, the need also arises to make equipment that meets a wide variety of needs in this area. For example, many individuals do not have a gym or training facility nearby or one that is convenient enough that they will alter their lifestyle to attend. For those people home fitness equipment is the desirable solution. In an effort to appeal to a broader clientele, some institutions use specified floor space for more than one purpose. In either case, home use or serial temporary institutional use, collapsibility for easy storage is a key element.

In addition, particularly in the home use, the lack of assembly is of vital importance in the success of a product. A product will not be used unless it is assembled. Some people do not or cannot assemble products for use. Those products get sent back as returns, purchased but never used, or not purchased at all. Therefore, lack of or at least minimizing assembly is greatly desirable in any product. Since most legitimate exercise equipment is fairly large, this lack of assembly and collapsibility for storage go hand in hand as highly desirable in many categories of fitness equipment, especially home fitness. Using the user's body weight as a resistance source, or lightweight resistance elements such as springs, greatly reduces the shipping weight and therefore the shipping costs. Attempts have been made to incorporate these features in varying methods, but few with success. None have created a versatile device with a great range of resistance potential that is pre-assembled. The invention as disclosed herein satisfies all these criteria.

SUMMARY OF THE INVENTION

In one aspect, the invention features an exercise device with an upper frame, which includes a user support. A rolling or guide element supports the upper frame and enables reciprocating movement of the upper frame relative to the lower frame. A lower frame supports the rolling element, allowing extension of a portion of the upper frame beyond a portion of the lower frame during the reciprocating movement. The rolling element, or guide element, of the device is preferably comprised of a carriage including load bearing elements that support the upper frame while being supported by the lower frame. The carriage my include a location system including a first tension member connecting the front end of the upper frame to the front end of the lower frame and a second tension member connecting the rear of the upper frame to the rear of the lower frame, each by way of a pulley mounted to the carriage. An alternative location system includes a first gear rack mounted to the upper frame, a second gear rack mounted to the lower frame and a gear rotatably mounted to the carriage, the gear engaging both the first rack and the second rack. The rolling element may alternately be comprised of front roller mounted on the lower frame and supporting the upper frame, and a pair of foot rollers mounted on the upper frame, one on the upper side of the lower frame and the other on the lower side of the lower frame.

The system may also include a base frame, which is movably mounted to and supports the lower frame. In the preferred embodiment the lower frame is pivotally mounted to the base frame and thereby enables an angular orientation of the lower frame, and upper frame supported thereon, relative to the base frame. An incline arm is movably (preferably pivotally) mounted to the lower frame and (preferably slidably mounted) the base frame, thereby allowing the lower frame to be releasably secured to the base frame in more than one position. This enables a displacement off the horizontal of the movement of the upper frame, thereby adding a vertical component of movement to the upper frame, and therefore the bodyweight of the user, during the reciprocating movement. Additional spring cords may be used to bias the upper frame toward one end of the lower frame. These spring cords or tension bands have a first end secured to the upper frame and a second end that can be releasably secured to the lower frame. The lower frame may also include a pivotally mounted foot bar that enables the user to place their feet thereon to push against while positioned on the upper frame.

One or more handles may also be used that are attached to a pliable tension member. This tension member can be a steel cable, coated steel cable, a rope, a belt or any other pliable tension member known in the art. The handles being accessible to a user positioned on the upper frame. The cable is attached by way of pulleys to the upper frame and the lower frame such that displacement of the handle results in movement of the upper frame relative to the lower frame. The pliable member is preferably routed through shoulder pads, with a pulley mounted on the upper portion thereof, the pad located on the upper frame. The shoulder pad pulley is preferably pivotally mounted to the shoulder pad and allowing 360-degree rotation about the pad. In addition, the pulley preferably rotates about the shoulder pad such that a tension member supported by the pulley would run substantially collinear with a long axis of the shoulder pad.

In another aspect, the invention includes a method of exercise using the elements of the device as previously disclosed. The exercise includes movement of the upper frame relative to the lower frame by displacement directly against the lower frame or by movement of one of the handles to move the cable, thus moving the upper frame relative to the lower frame. Movement of the upper frame against the spring bias, along the incline with respect to the base frame, or both, results in work done by the muscles of the user. The lower frame, and upper frame supported thereon by way of the support elements, can be adjusted by altering the position relative to the base frame and securing with the incline arm. This enables a change in workload to the user as well as varying use of the tension (spring) bands.

BRIEF DESCRIPTION OF THE DRAWINGS

The foregoing and other objects of this invention, the various features thereof, as well as the invention itself, may be more fully understood from the following description, when read together with the accompanying drawings, described.

For the most part, and as will be apparent when referring to the figures, when an item is used unchanged in more than one figure, it is identified by the same alphanumeric reference indicator in all figures.

DETAILED DESCRIPTION OF THE PREFERRED EMBODIMENT

The present invention is a linear motion exercise device that includes a user support that cantilevers over a frame, thus avoiding an extraneous support frame as found on linear motion exercise devices currently in the art. This support frame in the prior art is also traditionally used to mount pulleys that allow mechanical communication between handles and the user support. The pulleys allow the user support to be displaced relative to the support frame when the handles are moved. With the cantilevering system, in the absence of the extraneous frame, a cable and pulley system is used under the user support. Access of the handles is provided to the user through the shoulder pads of the device.

Figure 1:
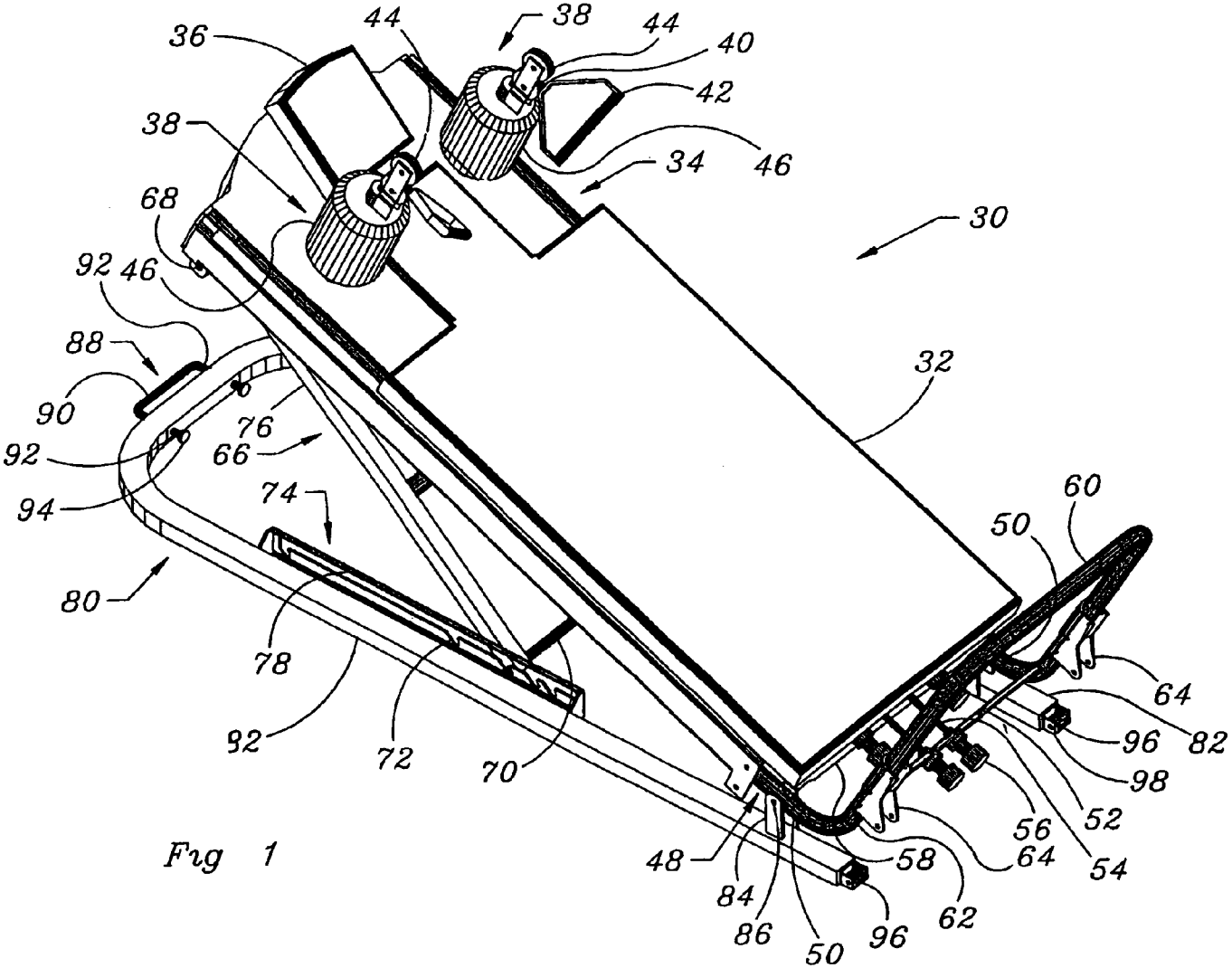
FIG. 1 is an isometric view of a cantilevering linear motion exercise device, the device produced in accordance with the present invention.

Referring to the drawings, an isometric view of the device 30 is shown in FIG. 1. The device 30 includes a seat back 32, which is supported by an upper frame 34. A headrest 36 is movably supported on the upper frame 34. The headrest 36 articulates with respect to the upper frame 34 to allow for an upward or "in use" position, as shown here, or the headrest 36 may also be positioned flat to the upper frame 34 for storage and shipping. The headrest 36 is positioned adjacent to and between two shoulder pad assemblies 38, which are also mounted to the upper frame 34.

In the preferred embodiment, the shoulder pad assembles 38 serve a duel purpose. First, they act as a structural mode of force transmission between the user and the upper frame 34. The second function of the shoulder pad assemblies 38 act as a support conduit for the handle cable 40, which is accessed by the user at handles 42. The cable passes through a pair of pulleys 44 that are rotatably mounted to the top portion of each shoulder pad assembly 38. The handle cable 40 then passes through the shoulder pad 46 and is routed under the upper frame 34 to enable articulation of the upper frame 34 when one or both of the handles 42 are displaced.

A lower frame 48 supports the upper frame 34 and associated components. The lower frame 48 is shown here includes a pair tubular structural members 50 positioned substantially under the upper frame 34 near the outside edges. At the foot end of the lower frame 48 is a cross bracket 52 which joins the pair of tubular structural members and enables a method of attachment of the spring cords 54.

The spring cords 54 are a bias system, which provides resistance to movement of the upper frame 34 away from the foot end (second end) of the lower frame 48. The spring cords 54 are fastened to spring knobs 56 which can be releasably secured to the cross bracket 52. The unseen distal ends of the spring cords 54 are mounted to the head end (first end) of the upper frame 34. When the spring knobs 56 are attached to the cross bracket 52, tension is produced to bias the upper frame toward the foot end of the lower frame 48. When the spring knobs 56 remain supported by the foot end plate 58 of the upper frame 34, no tension is produced to the movement of the upper frame 34.

A foot support 60 is mounted to the foot end of the lower frame 48. Here in the preferred embodiment, the foot support 60 is pivotally mounted to the lower frame 48 about a pivot 62 by each of two foot brackets 64. This upright position of the foot support 60 is a typical "in use" position, in that it offers a means of applying a force by a user to displace the upper frame 34 away from the foot end of the lower frame 48. The purpose of the pivotal mounting of the foot support 60 is to allow the foot support 60 to fold down to reduce shipping and storage area.

In the preferred embodiment, additional features can be added to provide additional utility to the device. One such example is by providing the exercise device with another form of resistance, specifically the ability to incline the lower frame 48. The device will function on the flat, but this feature is desirable in the addition of resistance that can be provided above the spring cords 54. This is illustrated by use of the incline arm 66. One end of the incline arm 66 is pivotally mounted to the head end of the lower frame 48 at the pin 68. The other end of the incline arm 66 includes a support rod 70. The distal ends of the support rod 70 are releasably engaged in the notches 72 of the base rack 74. The weight of the incline arm 66 causes the rod 70 to fall in each notch 72 as the lower frame 48 (and upper frame 34 supported thereon) is inclined by lifting the head end of the upper 34 or lower frame 48. The sloped edges of the notches 72 allow the rod 70 to pull up and back, as when the part is lifted, but provides structural support when in an inclined state. To lower the upper 34 and lower 48 frames, the arm 66 is lifted slightly by the user to release the rod 70 from a notch 72 and the user pulls up on the side bar 76 as the upper 34 and lower 48 frames are lowered. The top frame 78 of the base rack 74 prevents the rod 70 from completely disengaging from the base rack 74 during the lowering process.

The final support component of the device 30 is the base 80. The base 80 includes and supplies structural support for the afore noted base rack 74 as they are secured to a base tube 82, one on each side of the base 80. The base 80 also provides the support for the lower frame 48 at the foot end. In the preferred embodiment, this support is managed by a pair of ears 84 secured to the base 80. Supported by the ears, away from the base tube 82, is a pivot 86 that enables support and angular articulation of the lower frame 48 with respect to the base 80 as previously disclosed.

At the head end of the base 80 is a retractable handle 88. The base handle 88 includes a grip 90 that the user can grasp with one hand. Extending from the grip 90 are a pair of parallel extensions 92, which pass through holes in the head end of the base 80. A pair of caps 94 allows a restricted movement of the handle 88 through the holes in the base 80. When the user grasps and lifts the device 30 by use of the handle 88, the head end of the unit is raised and the foot end of the device 30 is then supported on the floor by the wheels 96. These wheels 96 are rotatably mounted to the base 80 by the wheel brackets 98 which are secured to the foot ends of the base tubes 82. The device 30 is then capable of being easily moved to a storage location or back out for use in an exercise session.

Figure 2:
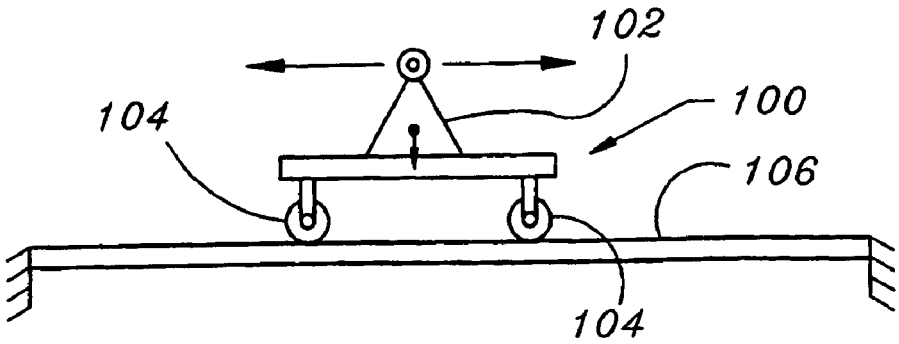
(Prior Art) Fig. 2
FIG. 2 is a schematic of a traditional prior art of the support mechanism used on a linear motion exercise device.

The compact nature of the device 30 can be contrasted to the traditional liner motion exercise devices as illustrated in FIG. 2. A carriage 100 supporting a weight 102 rolls on wheels 104, which are supported by a track 106. The weight, such as the user, can then be shuttled back and forth within the constraints of the track 106. Though a relatively constant load is placed on each wheel, the track 106 or frame of the unit must always be larger than the length of the carriage 100 plus the maximum stroke incurred by the largest user. This necessitates either a large storage area for the device when not in use or some element of assembly. To reduce shipping costs, it is likely that at least upon delivery of the unit, assembly will be required.

Figure 3A:
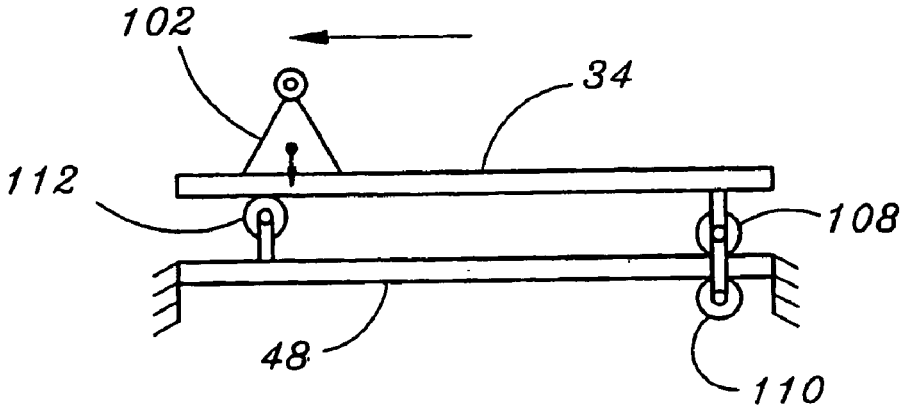
FIG. 3 is a schematic of a fixed wheel cantilevering support mechanism used on a linear motion exercise device.

In contrast, a cantilevering system is shown in FIG. 3*a*. The upper frame 34 includes a set of foot rollers, one upper roller 108 on top of the lower frame 48 and a lower roller 110 under the lower frame 48. At the head end, a single support roller 112 is used which is rotatably mounted to the lower frame 48, the roller 112 supporting the upper frame 34. The weight 102 has been shifted to the head end of the upper frame 34 to illustrate another feature of the device.

Figure 3B:
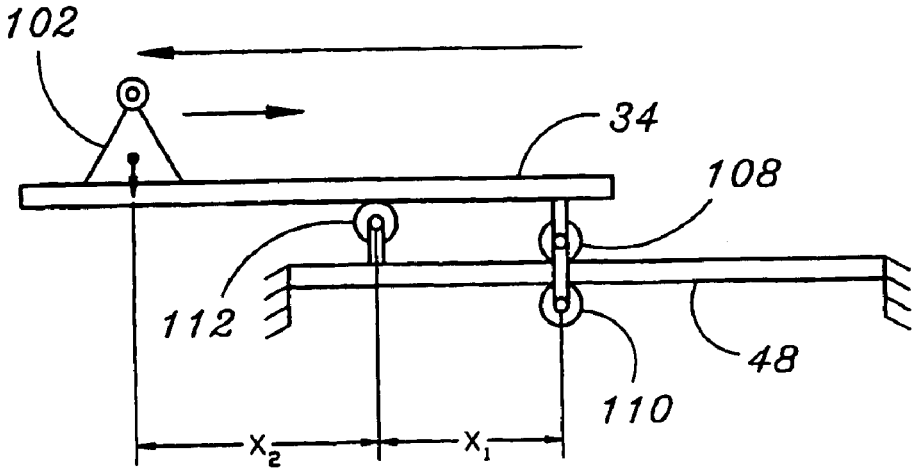

In FIG. 3*b*, the upper frame 34 is extended to cantilever over the lower frame 48, the loads in the bearings of the rollers change from that in the retracted state as shown in FIG. 3*a*. In the retracted state the radial load on the upper roller 108 and the support roller 112 differ by the placement of the weight 102. In this case, the support roller 112 predominantly supports the force of the weight. As the upper frame 34 extends, the support roller 112 and the lower roller 110 bear the burden of the load. As the upper frame 34 extends further, the distance $X_2$ increases and $X_1$ decreases. The sum of the moments of the system can result in high radial loads on the rollers.

Dealing with such loads is simply a design criterion as is evaluated in any design process. Unfortunately when it comes to exercise devices, loads are not only important in the evaluation of the structural integrity and therefore safely of the product, but in many cases it is critical to the function of the device. In comparable systems, higher loads result in more friction. Friction is damaging in the reduction of the useful life of the device, but perhaps more importantly, friction in a system reduces the effectiveness of the exercise device.

Human muscle has a greater force generating potential during the eccentric phase (elongation) of the contraction as compared to the concentric (shortening) phase. When the user performs an exercise, they are contracting (shortening) their muscles and applying a force to overcome the force of the resistance mechanism and the friction of the system. When the load is returned, the muscle lengthens only to have the force felt by the user as reduced by the amount of friction, since the friction acts as a brake. When the muscle is stronger, the load is less, due to the friction.

Size, weight and cost are all important design criteria, especially for a home fitness market. In some cases expensive rolling element bearings that can handle high loads make a product to expensive to produce. Sliding element bearings, such as plastic bushings, are often used because they can handle very high compression forces and are inexpensive to manufacture.

If they are used, the result is a greatly increased friction loss due to sliding friction rather than rolling friction.

Figure 4A:
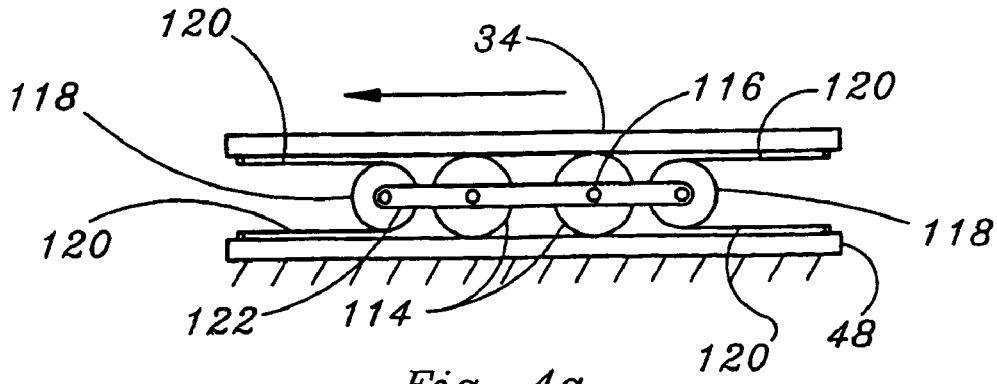
FIG. 4 is a schematic of a translating wheel cantilevering support mechanism with a cable tracking system.
Figure 4B:
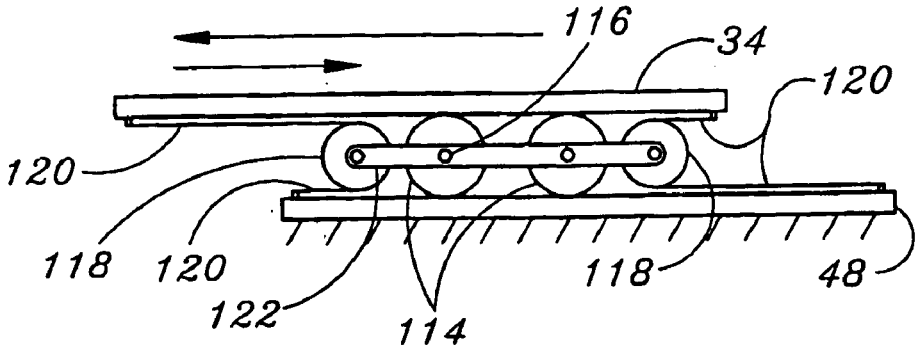

As a solution to this problem, FIG. 4 illustrates a method used in the preferred embodiment of the invention to provide a low cost and very efficient rolling element for a cantilevering linear movement device. The upper frame 34 is supported on the lower frame 48 by the rollers 114. If we assume a non-slip condition between the rollers 114 and both the upper frame 34 and the lower frame 48, as the upper frame 34 moves to the left (shown in FIG. 4*b*) the upper frame 34 will move two units to the left, with respect to the lower frame 48, for every one unit that the axis 116 of the rollers is displaced to the left. The load is applied as a compression force on the roller from the upper frame 34 to the lower frame 48, not the bearing in the axis of the roller as it was in FIG. 2 and FIG. 3. The roller 114 acts as a ball in a ball bearing with the upper frame 34 and the lower frame 48 acting as the bearing races.

Making such a mechanism useful in an exercise device likely requires some form of tracking device to insure that at any relative position of the upper frame 34 to the lower frame 48 results in a specific location of the rollers 114 relative to the lower frame 48. In an ideal situation where no slip between the upper frame 34 and the roller 144 and the lower frame 48 and the roller 114, a tracking mechanism is not necessary. Since these ideal conditions can rarely be found in the real world, a tracking mechanism has been developed.

The tracking system insures consistent positioning of the rollers 114 with each upper frame 34 position. The first method is shown in FIG. 4, which uses a pair or pulleys 118. They are positioned on the outside of the rollers 114. This position was selected for simplicity of the illustration and is not critical to the invention in that the left to right positioning relative to the rollers is not important. The pulleys 118 support a cable 120, which is fixed to the same end of the upper frame 34 and the lower frame 48 on each end. If the straight portions of the cables always remain substantially parallel to each other, the change in length of the portion from the pulley to the upper frame 34 will be the exact opposite of the change in portion from the pulley to the lower frame 48, on both ends. The pulleys 118 and rollers 114 are connected by a roller frame 122. Therefore regardless of the pulley diameter or the roller diameter, the system will always generate a consistent placement of the rollers 114 relative to the lower frame 48 with any position of the upper frame 34.

Figure 5A:
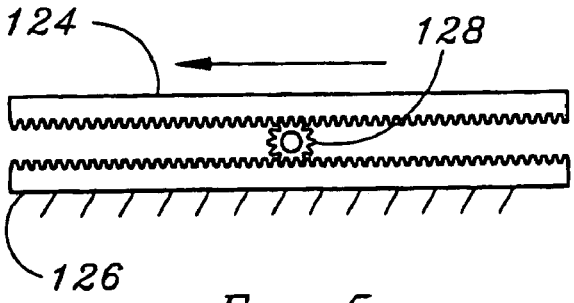
FIG. 5 is a schematic of a rack and pinion tracking system as could be used with a translating wheel cantilevering support mechanism for a linear motion exercise device.
Figure 5B:
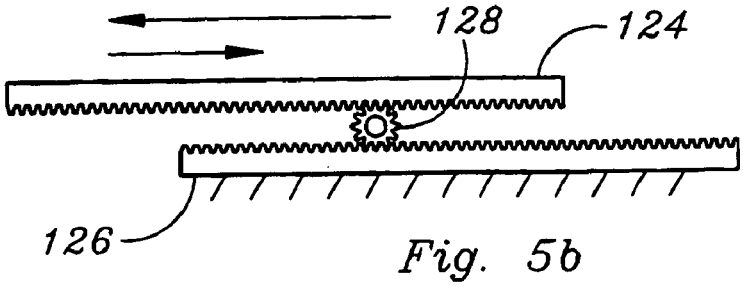

An alternative to the use of the pulleys 118 and the cables 120 in FIG. 4, is shown in FIG. 5. Here an upper gear rack 124 and a lower gear rack 126, which are driven relative to the other by a pinion gear 128 is used. The center of the pinion gear 128 will also move one unit to the left for every two units the upper rack 124 moves relative to the lower rack 126. As such, the upper rack 124 could be fastened to the upper frame 34 and the lower rack 126 to the lower frame 48 with the central axis of the pinion gear 128 mounted to the roller frame 122 of the previous figure, and a similar process would result. The inventor has used both methods and due to the inability of the cable and pulleys to "slip a tooth", the system as illustrated in FIG. 4 is preferred.

Figure 6A:
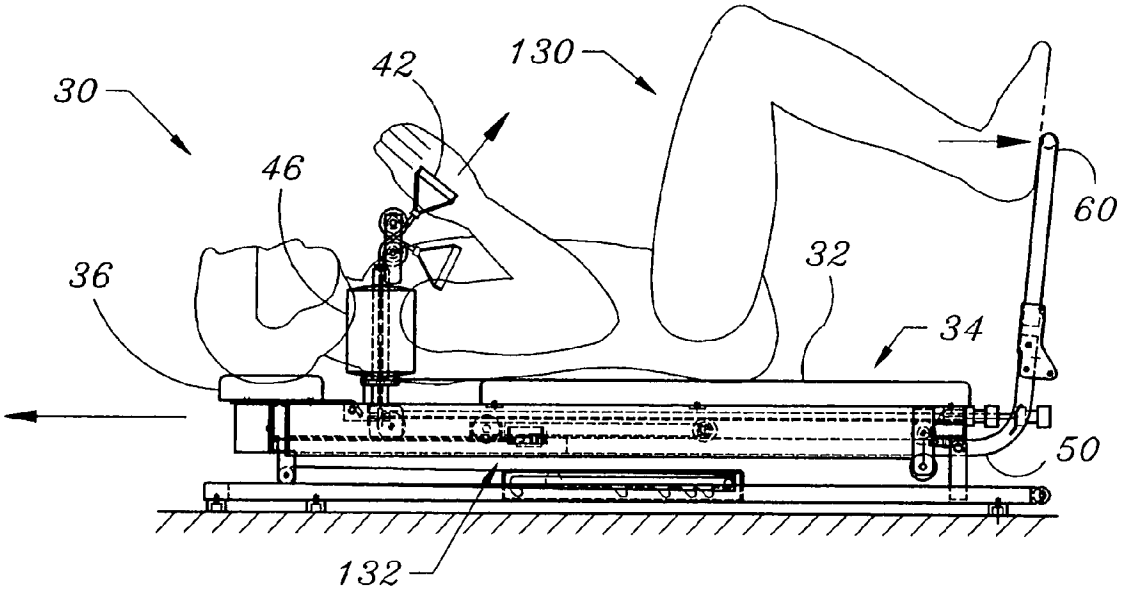
FIG. 6 is a side view of a cantilevering linear motion exercise device in both retracted and extended positions as it would typically be used, the device produced in accordance with the present invention.

The device 30 as shown in FIG. 1, is further illustrated in FIG. 6, as it would typically be used. In FIG. 6*a*, the device 30 is in a retracted state with a user 130 positioned supine on the seat back 32, head on the headrest 36 and shoulders against the pads 46. The user's feet are placed against the foot support 60. From this position, if the user extends their legs, pushing against the foot support 60, or pulls on either of the handles 42, the upper frame 34 will travel on the tubular members 50 of the lower frame 48, extending the upper frame 34 away from the foot support 60 which is attached to the foot end of the lower frame 48.

Figure 6B:
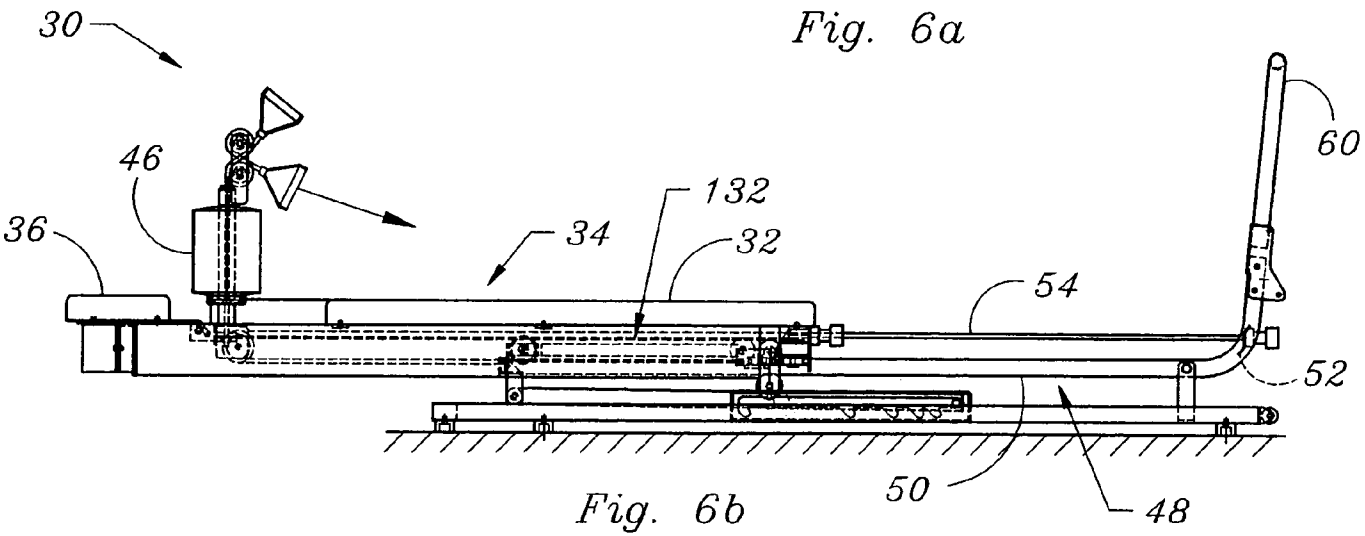

The device 30 is shown here to be in a flat (non-inclined) position. As such, the resistance that the user 130 must overcome is the tension offered by the spring cord 54, at least one of which is attached to the cross bracket 52 of the lower frame 48. The extended and cantilevered position of the upper frame 34 over the lower frame 48 is shown in FIG. 6*b*. Relative movement of the support carriage 132 is shown as the upper frame 34 moves from a retracted position (FIG. 6*a*) to an extended position (FIG. 6*b*).

Figure 7:
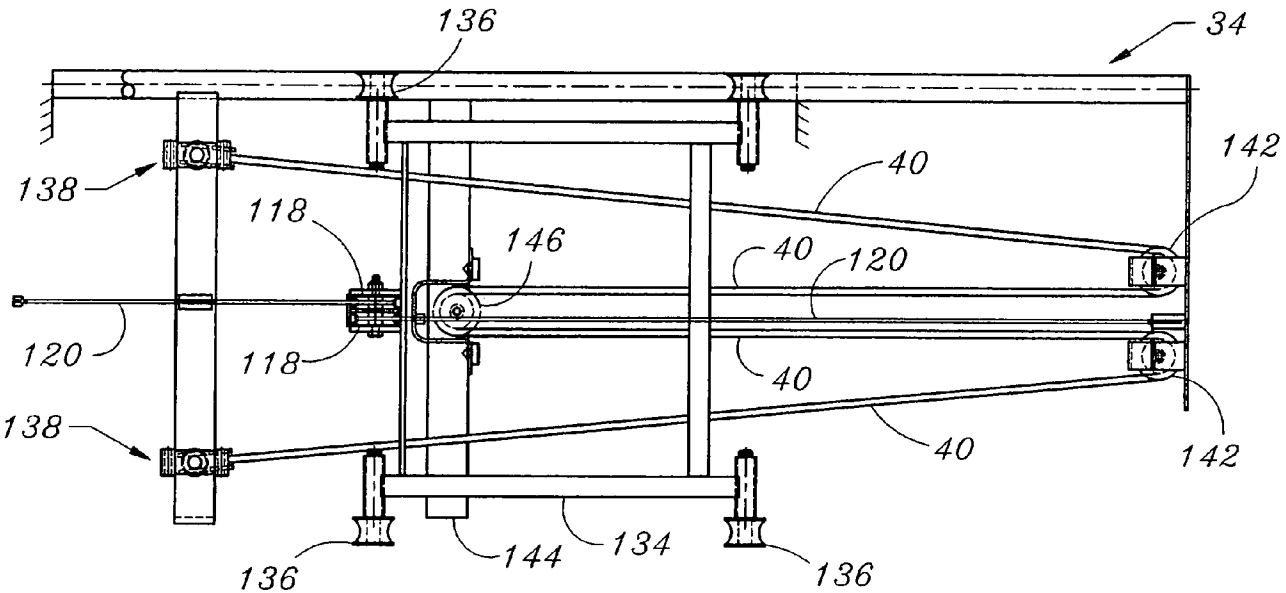
FIG. 7 is a plan view of a support carriage and cable drive of a cantilevering linear motion exercise device in a retracted position, the device produced in accordance with the present invention.
Figure 8:
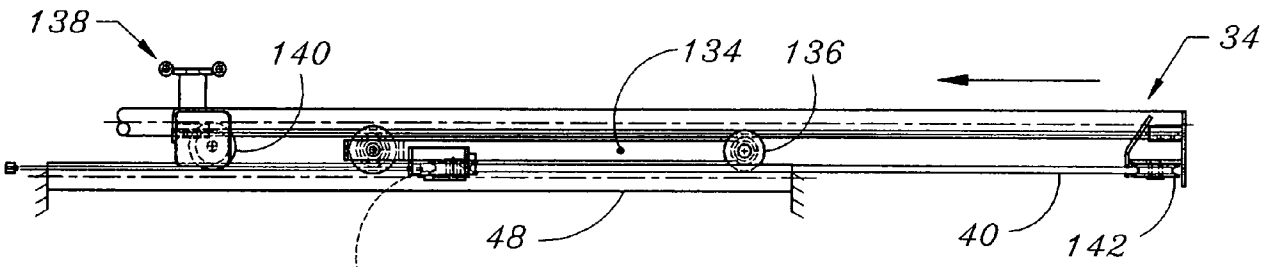
FIG. 8 is a side view of a support carriage and cable drive of a cantilevering linear motion exercise device in a retracted position, the device produced in accordance with the present invention.

Detail of the carriage and tracking system and the drive system from the articulating of the handles is further illustrated in FIGS. 7–10. In FIG. 7 a plan view of the exposed carriage 132 is shown. The side view of the same part is shown in FIG. 8. In these figures, one side of each of the upper and lower frames have been removed to more clearly show the features of the invention. In FIGS. 7 and 8, the upper frame 34 is a greater distance away from the carriage 132, and therefore denotes a retracted position (as in FIG. 6*a*). The carriage 132 includes a carriage frame 134 that supports four rollers 136 and a pair of pulleys 118. The pulleys support a pair of cables 120, one to the head end of the upper and lower frames (34 and 48 respectively) and one to the foot end. The structure is functionally equivalent to that illustrated in FIG. 4, only given the relative positions of the parts. The rollers 136 provide a rolling structural support between the upper frame 34 and the lower frame 48.

Figure 9:
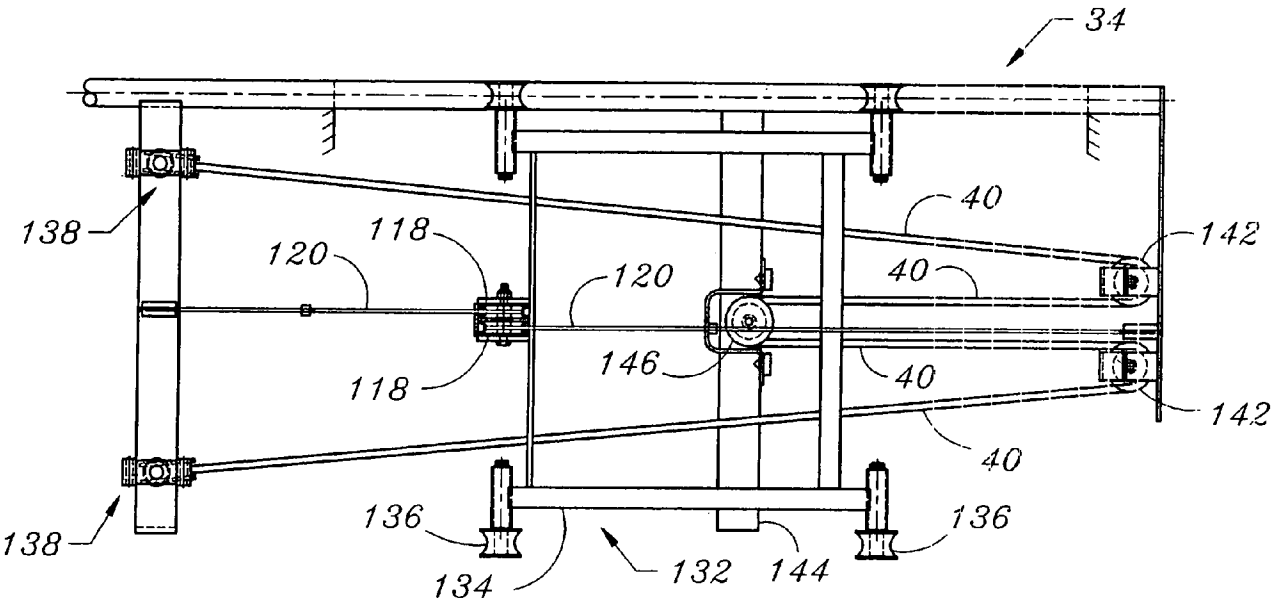
FIG. 9 is a plan view of a support carriage and cable drive of a cantilevering linear motion exercise device in an extended position, the device produced in accordance with the present invention.
Figure 10:
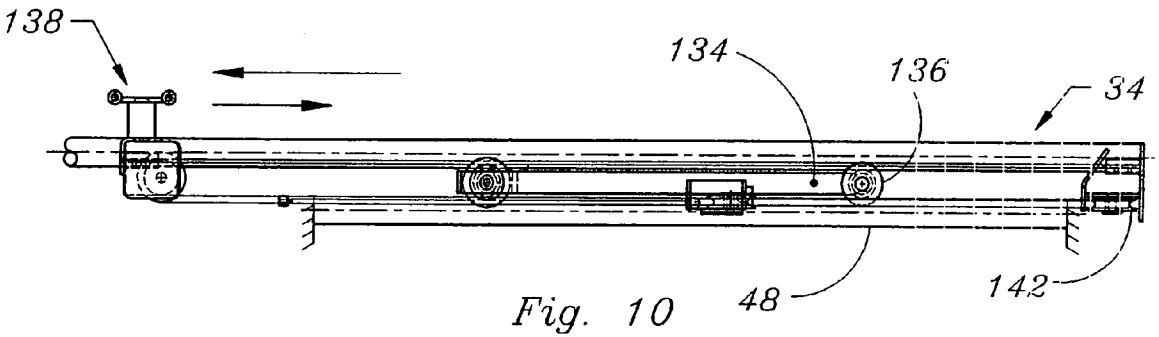
FIG. 10 is a side view of a support carriage and cable drive of a cantilevering linear motion exercise device in an extended position, the device produced in accordance with the present invention.

The shoulder pad assembly base 138 provides support for the shoulder pad assembles 38 (FIG. 1) to mount. The handle cable 40 can take a variety of forms, but has been determined by the inventor to preferably consist of a braded strand material such as a wire rope. In the case of a wire rope, it is desirable that it be coated to protect against fraying to increase its functional life. The handle cable 40 runs down through the shoulder pad assembly of the upper frame to the lower handle pulley 140. These pulleys 140 direct the cable 40 to the upper frame rear pulleys 142. The lower handle pulleys 140 and the rear pulleys 142 are both on the upper frame 34 and therefore their relative position does not change as the upper frame 34 moves relative to the lower frame 48. Therefore, the angle orientation of the lower handle pulleys 140 can remain constant and always align with the rear pulleys 142. The lower frame cross bar 144 supports a cross pulley 146 and like the rear pulleys 142, it is positioned horizontally. As either or both handles 42 are displaced by pulling them up through the shoulder pad assemblies, the cable causes the rear pulleys 142 to be pulled toward the base pulley 146. Since the rear pulleys are mounted to the upper frame 34 and the cross pulley is mounted on the lower frame 48, movement of the pulleys toward one another results in movement of the upper frame 34 relative to the lower frame 48. The movement of the upper frame 34 relative to the lower frame 48 is illustrated in FIGS. 9 and 10. Here it can be seen that the distance between the rear pulleys 142 and the cross pulley 146 has decreased from the previous set of figures.

Figure 11:
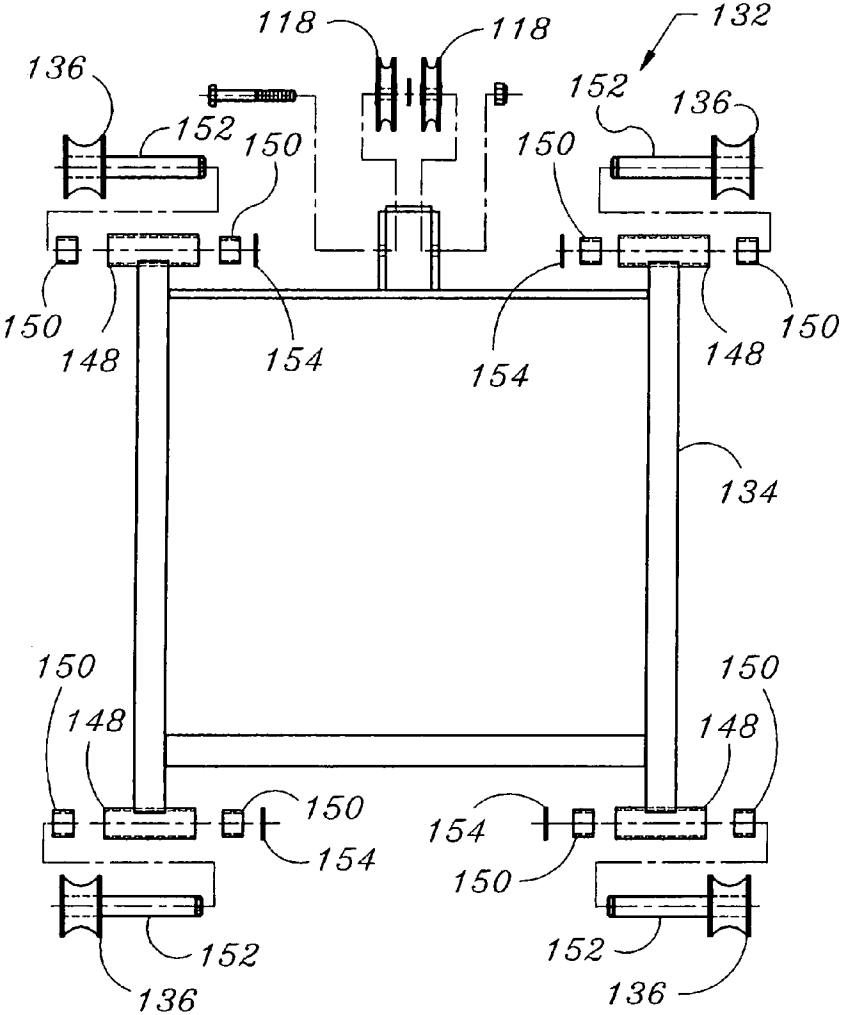
FIG. 11 is an exploded plan view of a support carriage used in a cantilevering linear motion exercise device, the device produced in accordance with the present invention.

An exploded view of the carriage 132 is shown in FIG. 11. The specifics of the framework of this portion of the invention are not considered critical to the novelty of the invention, but are shown to illustrate the ability of the device to provide a rolling element mechanism without traditional ball bearings. The carriage 132 includes a frame 134 that in this case supports four round tubes 148. These tubes receive bushings that are press fit to retain them in the tubes 148. The rollers 136 are press fit onto a shaft 152, which then rides within the bearing surface supplied by the bushings 150 when the shafts 152 are inserted therein. The shafts, with the rollers, are retained in the tubes 148 by the retaining clips 154 or any other method of fastening. Though the shaft does articulate with the bushing, producing sliding friction, the purpose of the carriage 132 is only to align the rollers and the pulleys 118. The loads against the articulating surfaces are very low, and therefore frictional forces are low as well. The high load is in the compression forces between the upper frame 34 and the lower frame 48 which are burdened by the integrity of the roller 136 as a compression force. Rolling element ball bearings can be used to rotatably mount the rollers 136 on the carriage 132 to reduce even this small frictional force of the bushings 150. In this case small bearings can be used with very low load ratings due to the relatively small forces that are being encountered.

Figure 12:
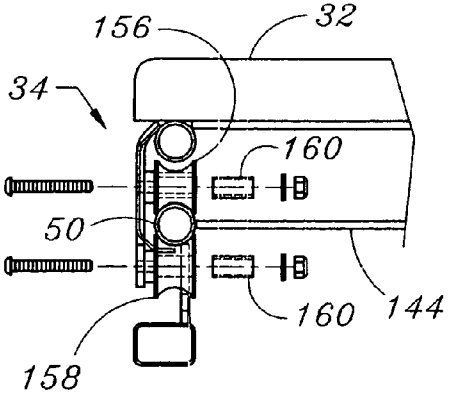
FIG. 12 is an end view of an end support used in a cantilevering linear motion exercise device, the device produced in accordance with the present invention.

As was shown in FIG. 3, when the center of gravity of the upper frame 34 of a cantilevering system passes over the front roller, the foot portion of the upper frame 34 wants to tip up. To avoid this a set of rollers are mounted to the foot portion of the upper frame 34, as shown in FIG. 12. Here a section of the side of the device is shown from the foot end. The seat back 32 on top of the upper frame 34 is seen with the exploded view of an upper rear roller 156 and a lower rear roller 158. The majority of the load is supported by the carriage 132 under most circumstances and could be designed to always carry the entire load, making these parts obsolete. However, in the interest if maximizing the functionality of the device 30, it is desirable to include these upper 156 and lower 158 rollers. These rollers are fit with whatever type of bearing 160 that is desirable for the design criteria of the device.

Figure 13:
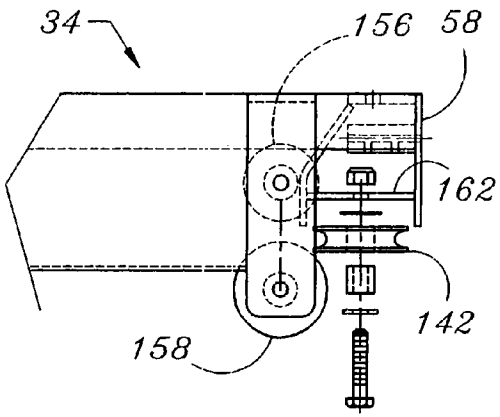
FIG. 13 is an exploded side view of an end cable pulley assembly used in a cantilevering linear motion exercise device, the device produced in accordance with the present invention.

A side view of the foot portion of the upper frame 34 is shown in FIG. 13. Here the relative positions of the previously noted upper 156 and lower 158 rollers are shown in their position on the upper frame 34. In addition, the rear pulleys 142 are shown in their mounting to the mounting bracket 162 and the foot end plate 58 on the foot end of the upper frame 34.

Figure 15:
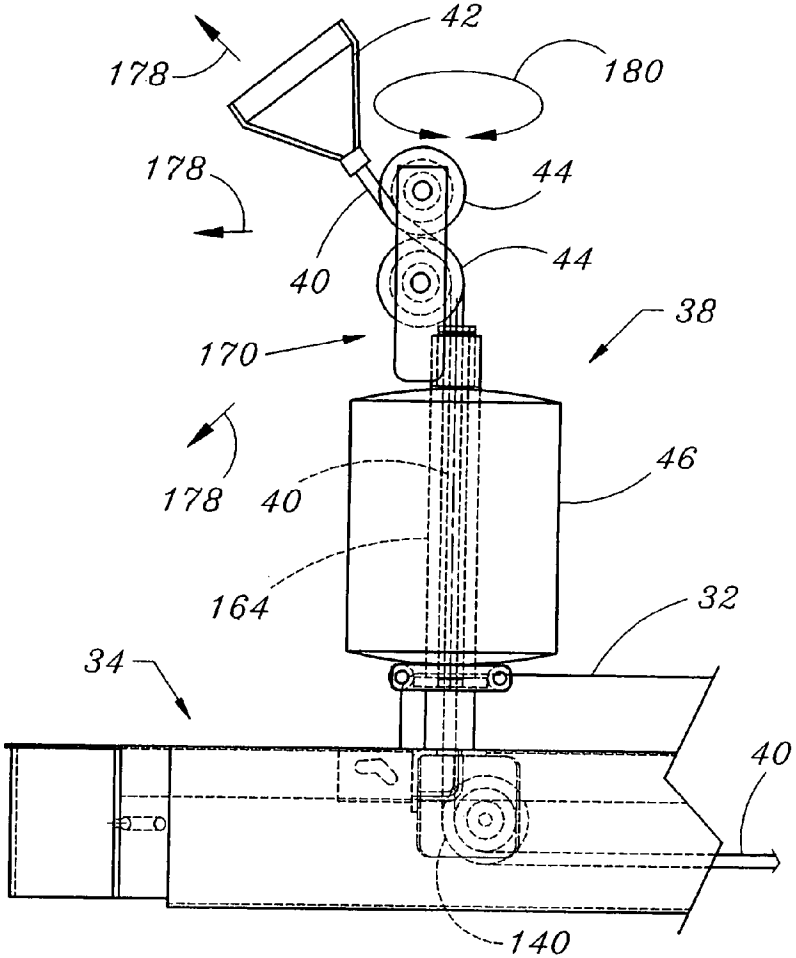
FIG. 15 is a side view of a shoulder pad and upper cable support used in a cantilevering linear motion exercise device, the device produced in accordance with the present invention.
Figure 14:
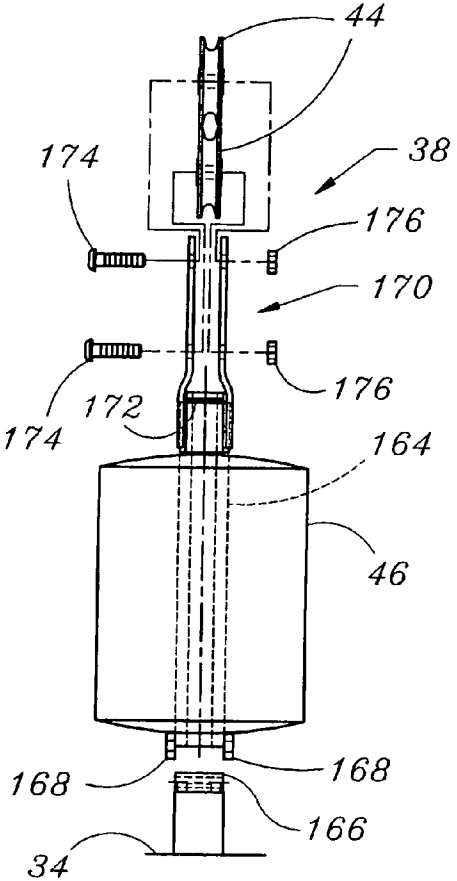
FIG. 14 is an exploded side view of a shoulder pad and upper cable pulley support used in a cantilevering linear motion exercise device, the device produced in accordance with the present invention.
Figure 16:
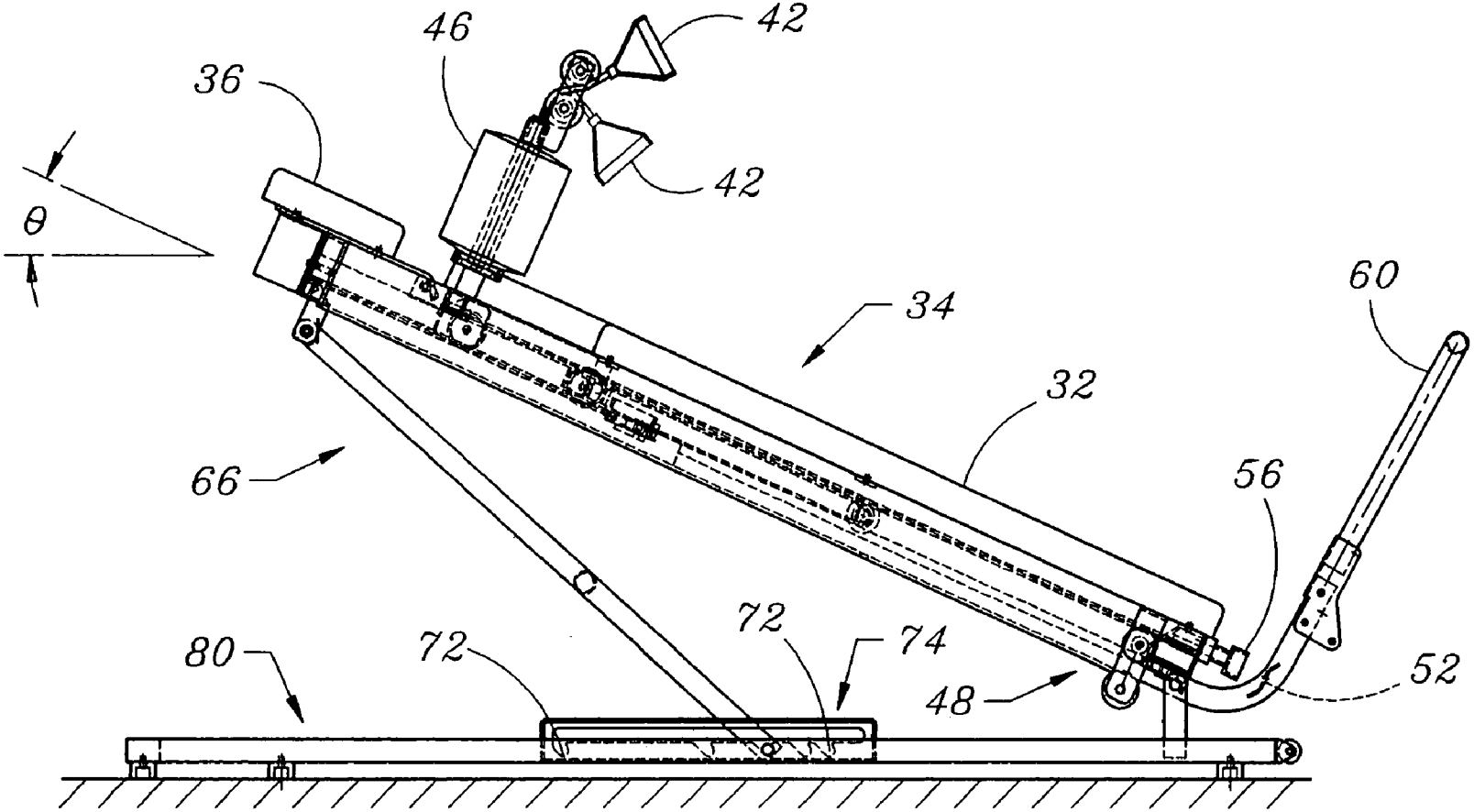
FIG. 16 is a side view of a cantilevering linear motion exercise device in an inclined state, the device produced in accordance with the present invention.

The movement of the upper frame 34 relative to the lower frame 48 as directed by the displacement of the handle cable 40 has been previously disclosed. Another important feature of the invention is the articulation of the handle 42 and handle cable 40 with respect to the shoulder pad assembly 38. This is illustrated in FIGS. 14 and 15. It is desirable to maximize the versatility of this feature in order to increase the amount of exercises the device 30 is capable of performing. A side view of one shoulder pad assembly 38 is shown in FIG. 14. The shoulder pad 46 is received by a hollow pad tube 164, which acts as a structural support for the pad 46. The tube 164 is mounted to the upper frame 34 at the shoulder pivot 166, connecting thereto by the mounting ears 168. At the upper end of the pad tube 164 is a shoulder pulley bracket 170. This bracket 170 is rotatably mounted to the upper end of the tube 164, allowing the bracket 170 to freely rotate about the long axis of the tube 164. The bracket can be secured to the tube 164 by any traditional fastening means that allows the bracket 170 to rotate on the tube 164. In the preferred embodiment this is accomplished by a retaining ring that is received by a groove 172 in the distal end of the tube 164.

The bracket 170 includes two pulleys 44, which are mounted to the bracket 170 by screws 174 and secured by nuts 176. This assembly method is not critical to the scope of the invention and any form of fastener, including rivets and pins, can also be used. Threaded fasteners are preferably used in that they allow replacement of the pulleys 44 in the event that they are damaged or worn.

A side view of the shoulder pad assembly 38 as mounted on the upper frame 34, is shown in FIG. 15. The handle 42 is fastened to one end of the handle cable 40, which passes between the pulleys 44. The bracket 170 supports the pulleys 44 such that the center of the cable 40 runs along the long axis of the pad tube 164. Because the bracket 170, and the handle 42 are capable of 360° of rotation, the center axis of the cable 40 is always collinear with the center axis of the tube 164. This maintains the constant alignment of the cable 40 with the lower handle pulley 140 regardless of the angular (as designated by arrows 178) or rotational (arrow 180) position of the handle 42. This versatility of the handle positioning enables a dynamic variety of exercise potential from the articulation of the handles 42 of the device 30.

An obvious necessity of a resistance training exercise device is the ability to provide resistance. The application of resistance can be accomplished by any number of methods. The disclosed invention includes spring cords 54 which can be selectively mounted to the cross bracket 52 of the lower frame 48 by way of the spring knobs 52 as previously disclosed in FIG. 1. The device 30 is intended to enable the weight of the user to be supported by the seat back 32. The upper frame 34, including the seat back 32, can be set on an incline with respect to the horizontal by use of the incline arm 66, as previously disclosed. The grade of incline is determined by the relative position of the notch 72 in the base rack 74, which supports the rod 70. The force the user must apply to overcome their weight and the weight of the upper frame 34 is determined by the sine θ, which is the sine of the angle made with the horizontal. Increasing this angle (θ) increases the force and work done with any given displacement of the upper frame 34. What is shown here are five notches 72 and the zero incline or flat position. With four spring cords 54 each with a potentially different tension and six incline positions (including zero), eliminating the zero incline and no spring cords combination (there would be no usable resistance to recoil the upper frame once it is extended) there are 89 different possible resistance loads. This variability offers a greatly versatile in the training device.

Figure 17:
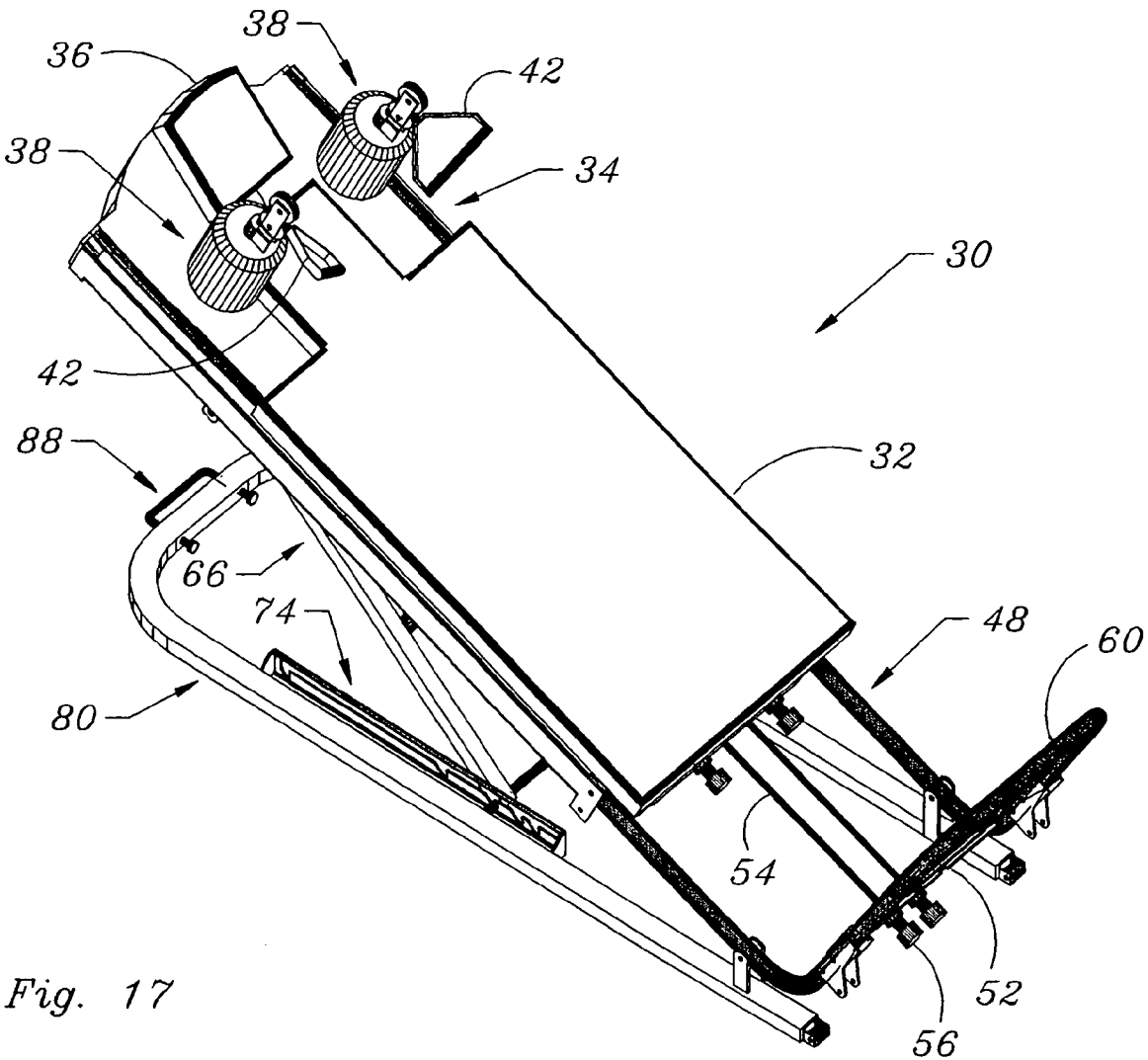
FIG. 17 is an isometric view of a cantilevering linear motion exercise device in an inclined state and resistance bands engaged, the device produced in accordance with the present invention.

As previously disclosed, work is done by displacement of the upper frame 34 relative to the lower frame 48. An isometric view of the device 30 is shown in FIG. 17, which shows the device in an extended or actuated position. Here it can be seen that the foot end of the seat back 32 (as part of the upper frame 34) is extended away from the foot support 60. The two center spring cords 54, which are connected to the cross bracket 52, are stretched, thus providing resistance to movement of the upper frame 34 up the incline, and away from the foot support 60. The upper frame 34 is shown here to be set on an incline by use of the incline arm 66 and the base rack 74.

Figure 18:
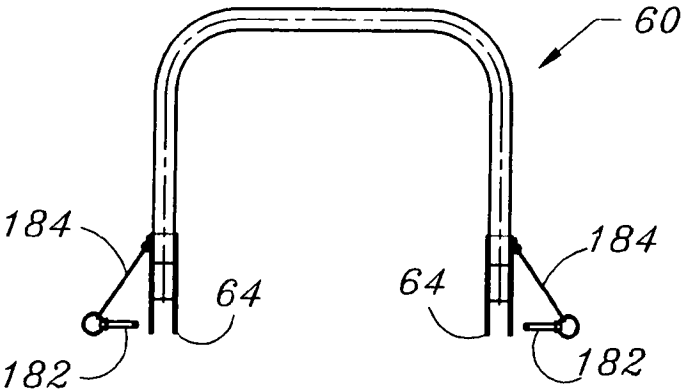
FIG. 18 is a front view of a rotating foot support used on a cantilevering linear motion exercise device in an inclined state, the device produced in accordance with the present invention.

The foot support is shown alone in FIG. 18. Locking pins 182 are tethered to the foot brackets 64, by tethers 184 to prevent loss of the pins 182. The locking pins 182 are used to allow the user to lock the foot support 60 into different position orientations relative to the lower frame 48 when assembled thereon. This will be detailed later in the disclosure.

Figure 19:
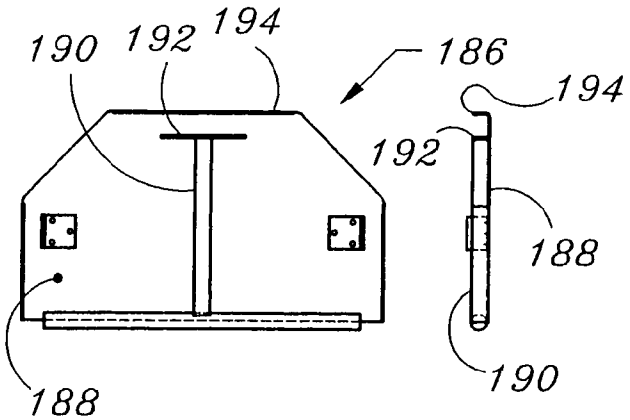
FIG. 19 includes a front and a side view of a detachable footplate used on a cantilevering linear motion exercise device in an inclined state, the device produced in accordance with the present invention.
Figure 20:
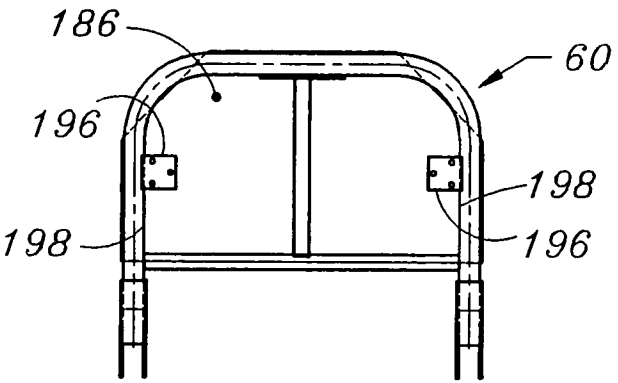
FIG. 20 is a front view of a rotating foot support with a detachable footplate mounted thereon, the device produced in accordance with the present invention.

An additional footplate 186 is shown in FIG. 19. The footplate 186 includes a flat surface 188, which allows the user a greater amount of surface area to be provided in contact with their feet while using the device 30. This increased area allows greater variety in foot positions and the increased area allows increased foot contact area. This decreases the pressure on the feet of the user. The decrease in pressure increases user comfort, thereby allowing the user to exercise more effectively. The footplate 186 may include a support rib 190 to provide additional structural support for the footplate 189. A lower lip 192 and an upper lip 194 provide mounting guidance and placement of the footplate 186 when secured on the foot support 60, as is shown in FIG. 20. A pair of spring clips 196 are used to releasably secure the footplate 186 to the foot support 60. This is done by clamping the spring clips 196 onto the side tubes 198 of the foot support 60.

Figure 21:
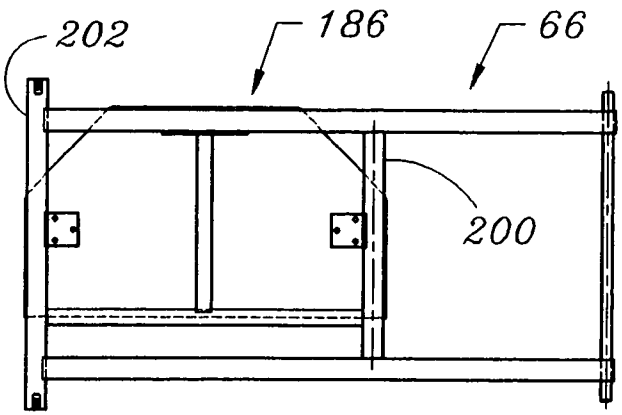
FIG. 21 is a front view of an incline frame with a detachable footplate mounted thereon for storage, the device produced in accordance with the present invention.

A means of storage of the footplate 186 when not in use on the foot support 60 is shown in FIG. 21. The incline arm 66 can be fitted with a mid-tube 200 to add additional structural support to the incline arm 66. In addition, the mid-tube 200 and the upper rod 202 of the incline arm 66 are positioned at the same centerline dimension as the side tubes 198 of the foot support 60, thus allowing for releasable attachment of the footplate 186 to either the foot support 60, to be used, or to the incline arm 66 for storage.

Figure 22:
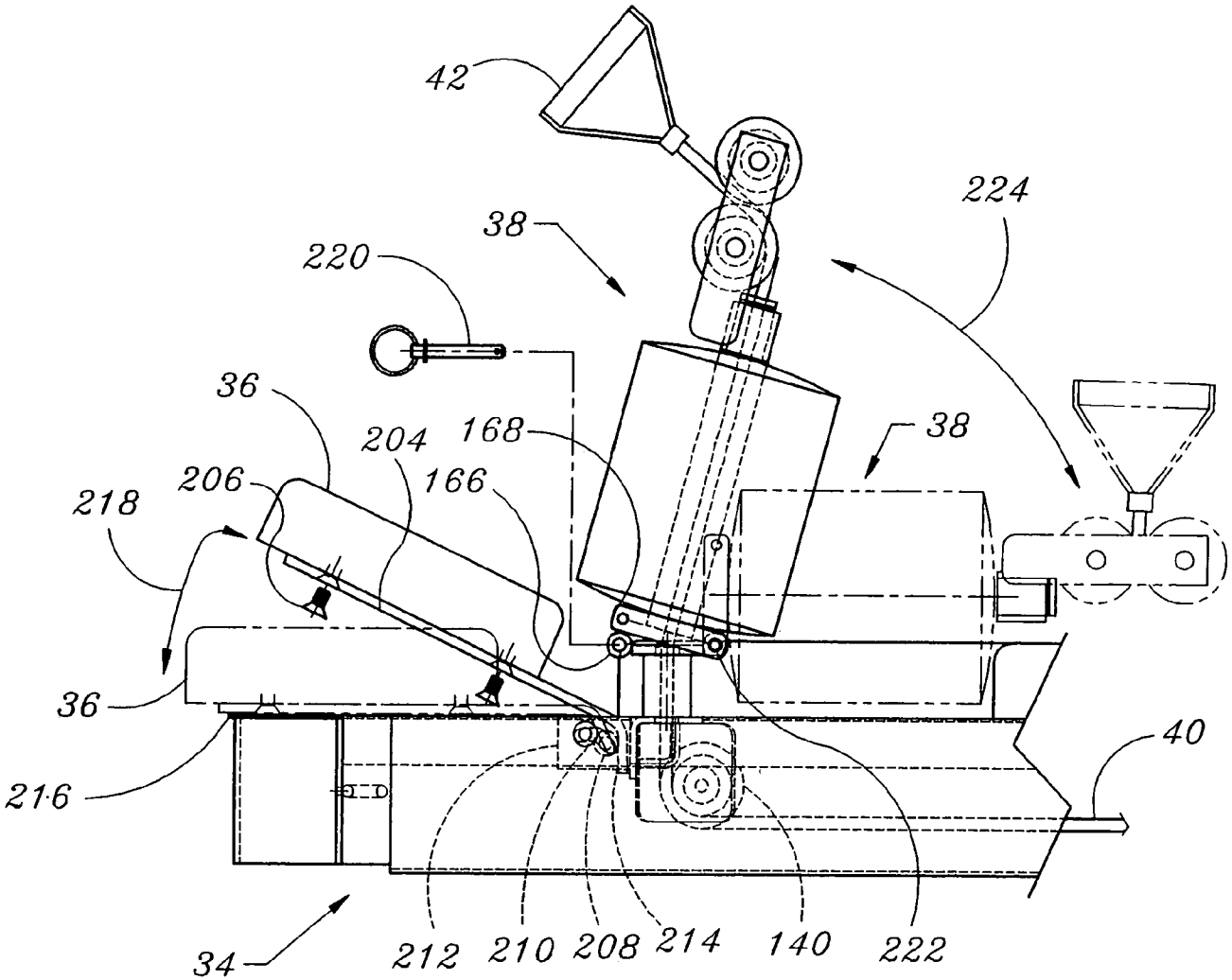
FIG. 22 is a side view of a movable headrest and storable shoulder pad and upper cable support as used in a cantilevering linear motion exercise device, the device produced in accordance with the present invention.

Storage of the device 30 is accomplished by several collapsible elements of the device 30. The headrest 36 and the shoulder pad assembly 38 are illustrated in FIG. 22. The headrest 36 includes a head bar 204, which is fastened to the headrest 36 by screws 206. The head bar 204 includes a receiver tube 208 that houses a pin, which moves within a slot 210 in the ears 212 mounted to the upper frame 34. When the headrest 36 and attached head bar 204 are rotated up and moved toward the shoulder pad assembly 38, a flat 214 on the distal end of the head bar 204 rests against a structure on the upper frame 34 to secure the headrest 36 in this rotated and therefore elevated position. To rotate the headrest 36 down, the headrest 36 and attached head bar 204 are pulled up and away from the shoulder pad assembly 38, the receiver tube 208 is guided by the slot 210 to a position such that the flat 214 is able to clear the structure on the upper frame 34 to allow the headrest 36 to rotate to an orientation that is supported by and substantially parallel to the head plate 216. The arrow 218 designates this movement.

A second aspect of the collapsibility of the device 30 is also shown in FIG. 22. The shoulder pad assembly 38 is pivotally mounted to the upper frame 34 by the mounting ears 168 of the shoulder pad assembly 38, which mounts to the shoulder pivot 166 that is part of the upper frame 34. When in the upright or "in use" position, a locking pin 220 is used to prevent rotation of the shoulder pad assembly 38 to the upper frame 34. When the locking pin 220 is removed, the shoulder pad assembly 38 can rotate down about rear axis 222 to the storage position as illustrated by the arrow 224. These simple movements allow for a great reduction in size, which is advantageous for shipping and storage.

Figure 23:
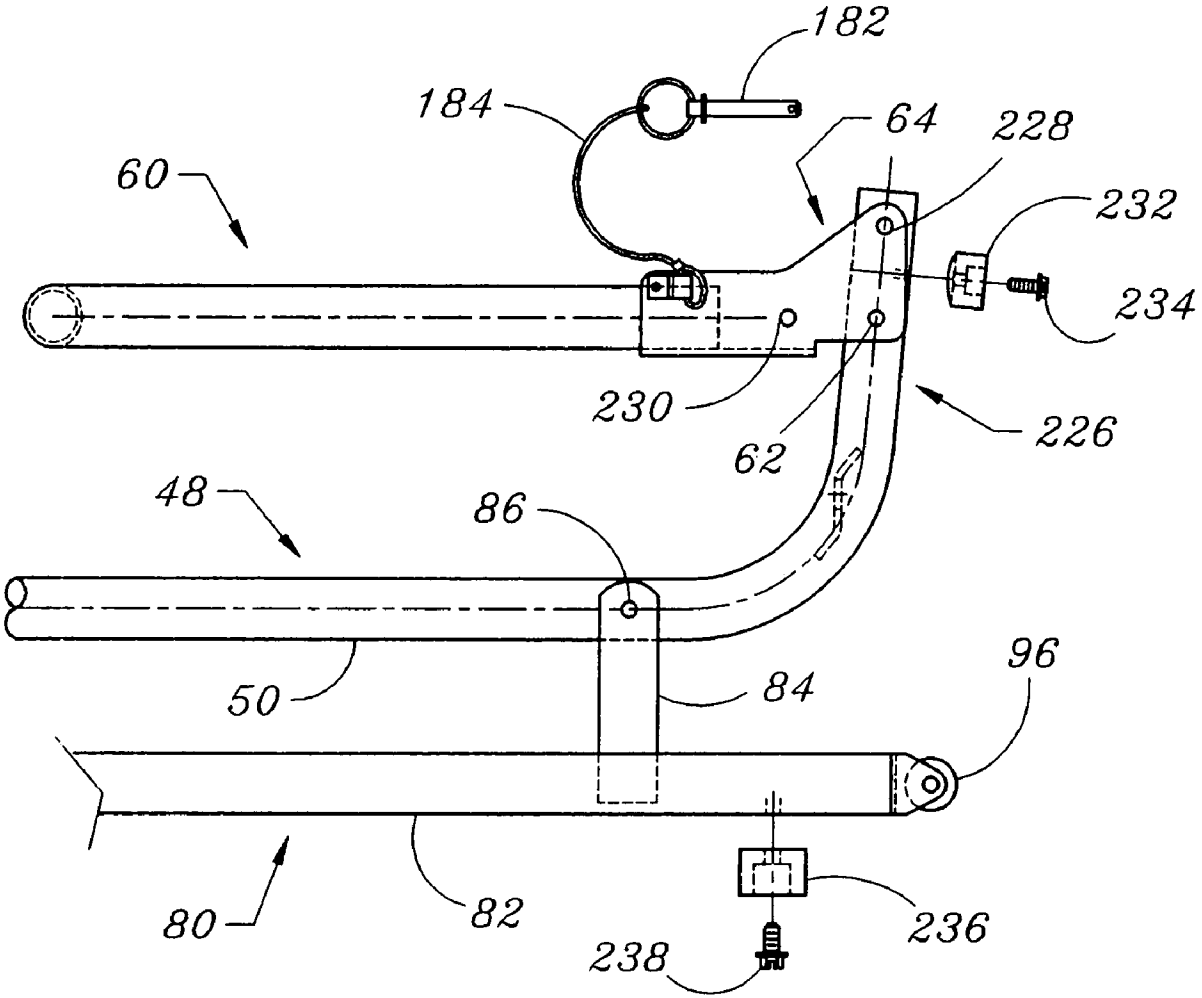
FIG. 23 is a side view of a rotating foot support in a storage position, the foot support used on a cantilevering linear motion exercise device, as produced in accordance with the present invention.

The other storage feature of the device 30 is shown in FIG. 23. The upper frame is not shown, only the foot end portion of the base 80, including the base tube 82. The collapsing feature is in the foot support 60. The foot bracket 64 provides a means of pivotal attachment of the foot support 60 to the lower frame 48 at pivot 62. The locking pin 182 is capable of being received by a hole in the vertical portion 226 of the tubular structural member 50, which can be aligned with either the back hole 228 (as shown here) or the front hole 230, both on the foot bracket 64. When the pin 182 locks the front hole 230 to the vertical portion 226, the foot support 60 is locked in an upright or "in use" position. When the back hole 228 is used (as shown) the foot support 60 is locked in a down or "storage" position.

A set of feet, though not considered necessary to the novelty of the invention, can be used to protect the surface area or flooring on which the device 30 while being used or stored. An upper foot 232 is fastened to the vertical portion 226 by screw 234. This allows the device 30 to be rotated vertically and supported by the wheel 96 and the upper foot 232 in an upright and stored position. A base foot 236 is mounted to the base tube 82 by screw 238. This provides a supportive structure to protect the floor while the unit is being used.

Figure 24:
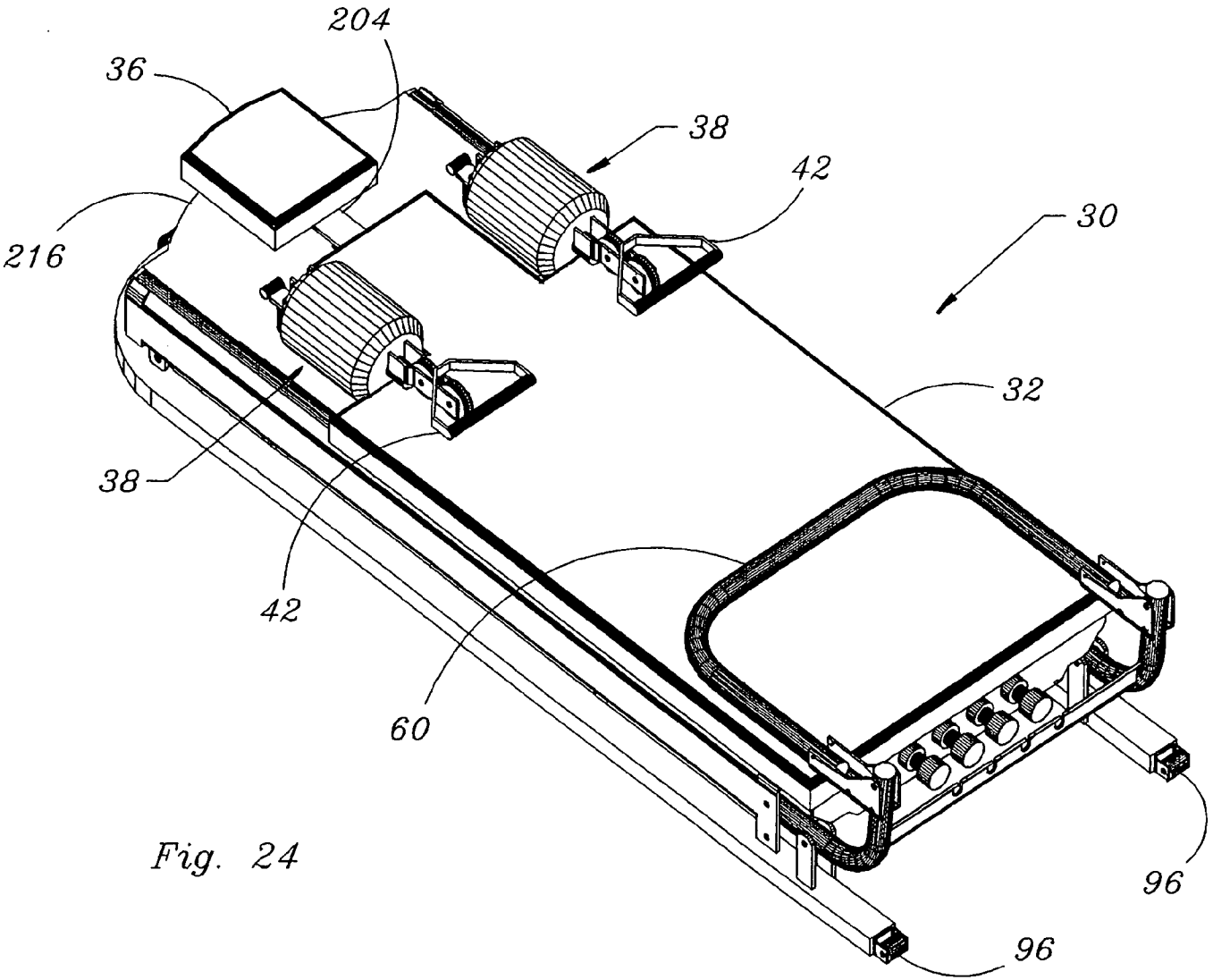
FIG. 24 is an isometric view of a cantilevering linear motion exercise device in a storage state, the device produced in accordance with the present invention.

An isometric view of the device 30 in a storage state is illustrated in FIG. 24. The shoulder pad assemblies 38 are rotated down onto the upper frame 34. The foot support 60 is folded down to a close proximity of the seat back 32 and the headrest 36 is resting on the head plate 216. This combination allows for minimal storage size and allows for the device 30 to be shipped to a consumer fully assembled. Only the adjustments as noted are repositioned to quickly and easily make the unit ready for use.

Figure 25:
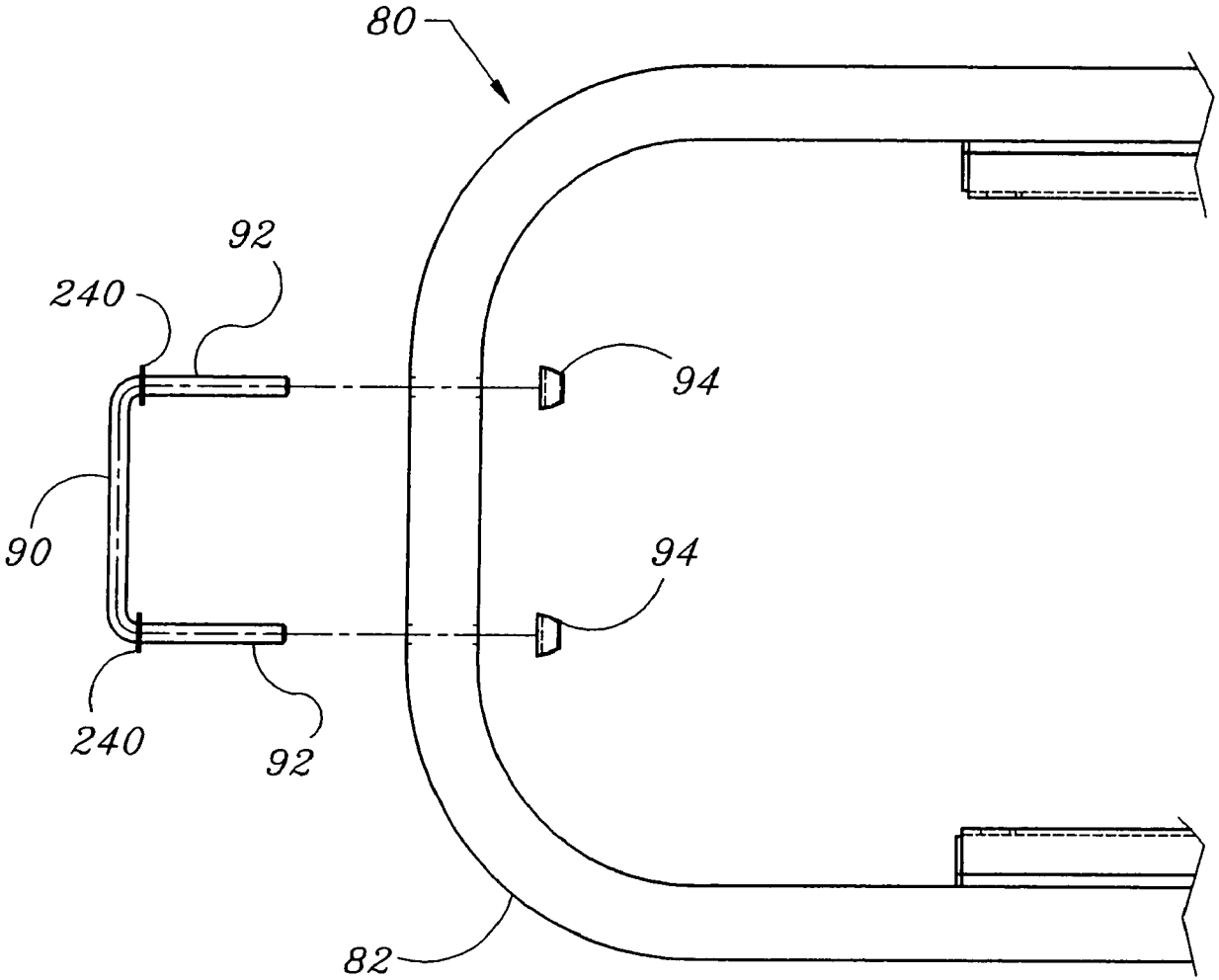
FIG. 25 is a plan view of a retractable handle used on a cantilevering linear motion exercise device, produced in accordance with the present invention.

When the unit is to be moved to be stored or retrieved to be used, a base handle 88 and the wheels 96 (as previously noted) provide ease of mobility of the device 30. This is further illustrated in FIG. 25. In the interest of minimizing storage and shipping size, the base handle 88 is also collapsible to the base frame 80. The base handle 88 includes a grip 90 used by a hand of the user. A pair of extensions 92 are positioned parallel to each other and are received by holes in the base tube 82. A pair of caps 94 are used to secure the ends of the extensions 92 through the holes, thus preventing their unintentional removal from the base tube 80. A pair of washers 240 can be used to prevent the grip 90 of the base handle 88 from being positioned to close to the base tube 82, not allowing easy access to the grip 90 by the user. When the user desires to use the base handle 88, they need only grasp the grip 90 and pull the handle 88 out to use. In shipping or storage the grip of the base handle 88 can be moved toward the base tube 82 sliding the extensions 92 through the holes in the base tube, thus minimizing storage space.

What is claimed is:

1. An exercise device comprising:

an upper frame including a user support;

a rolling element supporting said upper frame and enabling reciprocating movement of said upper frame; and a lower frame including a first end and a second end supporting said rolling element and allowing displacement of a portion of said upper frame beyond said second end of said lower frame.

2. An exercise device as in claim 1, further comprising a handle attached to a pliable tension member, the member attached to said upper frame and said lower frame, such that displacement of said handle causes movement of said upper frame relative to said lower frame.

3. An exercise device as in claim 2, wherein said pliable member is routed through a shoulder pad mounted on said upper frame.

4. An exercise device as in claim 2, wherein said pliable tension member is a member selected from the group consisting of a steel cable, a coated steel cable, a rope and a belt.

5. An exercise device as in claim 2, wherein said pliable tension member attaches to said upper frame and said lower frame by use of pulleys.

6. An exercise device as in claim 1, wherein said upper frame includes a shoulder pad assembly with a pulley mounted on an upper portion thereof.

7. An exercise device as in claim 6, wherein said shoulder pad assembly is movably mounted to said upper frame.

8. An exercise device as in claim 7, wherein said shoulder pad assembly is pivotally mounted to said upper frame.

9. An exercise device as in claim 6, wherein said pulley is mounted to allow 360-degree rotation about said shoulder pad.

10. An exercise device as in claim 9, wherein said pulley rotates about said shoulder pad such that a tension member supported by said pulley would run substantially collinear with a long axis of said shoulder pad.

11. An exercise device as in claim 1, further comprising a base frame which is movably mounted to said lower frame.

12. An exercise device as in claim 11, further comprising an incline arm movably mounted to said lower frame and said base frame thereby allowing said lower frame to be releasably secured to said base frame in more than one position.

13. An exercise device as in claim 12, wherein said incline arm is pivotally mounted to said lower frame and slidably mounted to said base frame.

14. An exercise device as in claim 11, wherein said lower frame is pivotally mounted to said base frame.

15. An exercise device as in claim 11, further comprising an incline arm movably attached to said lower frame and said base frame.

16. An exercise device as in claim 15, wherein said incline arm is pivotally mounted to said lower frame and slidably mounted to said base frame by way of a toothed rack mounted to said base frame.

17. An exercise device as in claim 1, further comprising at least one tension band with a first end secured to said upper frame and a second end releasably secured to said lower frame.

18. An exercise device as in claim 1, wherein said lower frame includes a foot bar thereby enabling a user to place their feet on the foot bar while positioned on said upper frame.

19. An exercise device as in claim 18, wherein said foot bar is pivotally mounted to said lower frame.

20. An exercise device as in claim 1, wherein said user support is comprised of a substantially flat pad which covers a surface of said upper frame.

21. An exercise device as in claim 1, wherein said rolling element is comprised of a carriage including load bearing elements that support said upper frame while being supported by said lower frame and allowing movement of said upper frame relative to said lower frame.

22. An exercise device as in claim 21, further comprising a location system including a tension member connecting said upper frame to said lower frame by way of said carriage.

23. An exercise device as in claim 22, wherein said location system includes a first tension member connecting a first end of said upper frame to said first end of said lower frame by way of said carriage and a second tension member connecting a second end of said upper frame to said second end of said lower frame by way of said carriage.

24. A exercise device as in claim 22, wherein said tension member is connected by way of said carriage by using a pulley mounted to said carriage and receiving said tension member.

25. An exercise device as in claim 21, further comprising a location system including a first gear rack mounted to said upper frame, a second gear rack mounted to said lower frame and a gear rotatably mounted to said carriage, the gear engaging said first gear rack and said second gear rack.

26. An exercise device comprising:

an upper frame including a user support;

a lower frame; and a guide element positioned between said upper frame and said lower frame thereby enabling measurable displacement of said upper frame relative to said lower frame, wherein said guide member is displaced substantially one half of said measurable displacement relative to said lower frame.

27. An exercise device as in claim 26, further comprising a handle attached to a pliable tension member, the member attached to said upper frame and said lower frame, such that displacement of said handle causes movement of said upper frame relative to said lower frame.

28. An exercise device as in claim 27, wherein said pliable member is routed through a shoulder pad mounted on said upper frame.

29. An exercise device as in claim 27, wherein said pliable tension member is a member selected from the group consisting of a steel cable, a coated steel cable, a rope and a belt.

30. An exercise device as in claim 27, wherein said pliable tension member attaches to said upper frame and said lower frame by use of pulleys.

31. An exercise device as in claim 26, wherein said upper frame includes a shoulder pad assembly with a pulley mounted on an upper portion thereof.

32. An exercise device as in claim 31, wherein said shoulder pad assembly is movably mounted to said upper frame.

33. An exercise device as in claim 32, wherein said shoulder pad assembly is pivotally mounted to said upper frame.

34. An exercise device as in claim 31, wherein said pulley is mounted to allow 360-degree rotation about said shoulder pad.

35. An exercise device as in claim 34, wherein said pulley rotates about said shoulder pad such that a tension member supported by said pulley would run substantially collinear with a long axis of said shoulder pad.

36. An exercise device as in claim 26, further comprising a base frame which is movably mounted to said lower frame.

37. An exercise device as in claim 36, further comprising an incline arm movably mounted to said lower frame and said base frame thereby allowing said lower frame to be releasably secured to said base frame in more than one position.

38. An exercise device as in claim 37, wherein said incline arm is pivotally mounted to said lower frame and slidably mounted to said base frame.

39. An exercise device as in claim 36, wherein said lower frame is pivotally mounted to said base frame.

40. An exercise device as in claim 36, further comprising an incline arm movably attached to said lower frame and said base frame.

41. An exercise device as in claim 40, wherein said incline arm is pivotally mounted to said lower frame and slidably mounted to said base frame by way of a toothed rack mounted to said base frame.

42. An exercise device as in claim 26, further comprising at least one tension band with a first end secured to said upper frame and a second end releasably secured to said lower frame.

43. An exercise device as in claim 26, wherein said lower frame includes a foot bar thereby enabling a user to place their feet on the foot bar while positioned on said upper frame.

44. An exercise device as in claim 43, wherein said foot bar is pivotally mounted to said lower frame.

45. An exercise device as in claim 26, wherein said user support is comprised of a substantially flat pad which covers a surface of said upper frame.

46. An exercise device as in claim 26, wherein said guide element is comprised of a carriage including load bearing elements that support said upper frame while being supported by said lower frame and allowing movement of said upper frame relative to said lower frame.

47. An exercise device as in claim 46, further comprising a location system including a tension member connecting said upper frame to said lower frame by way of said carriage.

48. An exercise device as in claim 47, wherein said location system includes a first tension member connecting a first end of said upper frame to a first end of said lower frame by way of said carriage and a second tension member connecting a second end of said upper frame to a second end of said lower frame by way of said carriage.

49. An exercise device as in claim 47, wherein said tension member is connected by way of said carriage by using a pulley mounted to said carriage and receiving said tension member.

50. An exercise device as in claim 46, further comprising a location system including a first gear rack mounted to said upper frame, a second gear rack mounted to said lower frame and a gear rotatably mounted to said carriage, the gear engaging said first gear rack and said second gear rack.

51. A method of physical exercise comprising:

providing an exercise device of the type including an upper frame with a user support, a rolling element supporting said upper frame and enabling reciprocating movement of said upper frame and a lower frame including a first end and a second end supporting said rolling element and allowing displacement of a portion of said upper frame beyond a portion said second end of said lower frame;

positioning a user on said user support; and applying force to displace said user on said user support relative to said lower frame, thereby exercising muscles of said user.

52. A method of physical exercise comprising:

providing an exercise device of the type including an upper frame with a user support, a lower frame and a guide element positioned between said upper frame and said lower frame, thereby enabling measurable displacement of said upper frame relative to said lower frame, wherein said guide member is displaced substantially one half of said measurable displacement relative to said lower frame, and a handle attached to a pliable tension member attached to said upper frame and said lower frame;

providing a user in contact with said handle; and displacing said handle from a first position to a second position by said user, thereby displacing said upper frame relative to said lower frame and exercising muscles of said user.

* * * * *